US007082205B1

(12) United States Patent
Westermann

(10) Patent No.: US 7,082,205 B1
(45) **Date of Patent: *Jul. 25, 2006**

(54) METHOD FOR IN-SITU MEASURING AND CORRECTING OR ADJUSTING THE OUTPUT SIGNAL OF A HEARING AID WITH A MODEL PROCESSOR AND HEARING AID EMPLOYING SUCH A METHOD

(75) Inventor: Soren Erik Westermann, Fredensborg (DK)

(73) Assignee: Widex A/S, Vaerloese (DK)

( * ) Notice: Subject to any disclaimer, the term of this patent is extended or adjusted under 35 U.S.C. 154(b) by 0 days.

This patent is subject to a terminal disclaimer.

(21) Appl. No.: 09/830,922

(22) PCT Filed: Nov. 9, 1998

(86) PCT No.: PCT/EP98/07131

§ 371 (c)(1),
(2), (4) Date: May 3, 2001

(87) PCT Pub. No.: WO00/28783

PCT Pub. Date: May 18, 2000

(51) Int. Cl.
*H04R 25/00* (2006.01)

(52) U.S. Cl. ..... 381/312; 381/60

(58) Field of Classification Search ..... 381/56, 381/59, 96, 108, 121, 312, 316–318, 320
See application file for complete search history.

(56) References Cited

U.S. PATENT DOCUMENTS 4,596,902 A 6/1986 Gilman
6,173,063 B1 * 1/2001 Melanson ..... 381/312
6,353,671 B1 * 3/2002 Kandel et al. ..... 381/312
6,434,246 B1 * 8/2002 Kates et al. ..... 381/312
6,658,122 B1 * 12/2003 Westermann et al. ..... 381/312

FOREIGN PATENT DOCUMENTS

CH 624524 A5 7/1981

OTHER PUBLICATIONS

Gregory P. Widin, "The Meaning of Digital Technology", Hearing Instruments, vol. 38, No. 11, Nov. 1, 1987, p. 28 and 30, 32/33 74 XP000611160.

* cited by examiner

*Primary Examiner*—Suhan Ni
(74) *Attorney, Agent, or Firm*—Sughrue Mion, PLLC

(57) ABSTRACT

The application relates to an in-situ method to measure and correct or adjust sound signal presented to the eardrum by means of a hearing aid and a hearing aid employing such a method. The hearing aid comprises at least one microphone (1), at least one digital signal processor (2) for transforming the microphone signal into a transformed signal according to a desired transformation function, a receiver (3), a sensing means (4) for sensing the sound signal appearing in front of the eardrum and at least one comparison mans (5). A model of the electroacoustic system of the ear and the hearing aid is established and stored in the hearing aid, which model simulates the sound signal in the ear canal in front of the eardrum. The model is adapted in response of an error signal generated in case the difference between the representation of the sensed signal and the simulated sound signal and the simulated sound signal is above a predetermined threshold.

17 Claims, 2 Drawing Sheets

METHOD FOR IN-SITU MEASURING AND CORRECTING OR ADJUSTING THE OUTPUT SIGNAL OF A HEARING AID WITH A MODEL PROCESSOR AND HEARING AID EMPLOYING SUCH A METHOD

BACKGROUND OF THE INVENTION

The invention relates to a method to measure and correct or adjust the sound signal presented to the eardrum by means of a hearing aid in the operational position, including at least one microphone, at least one digital signal processing system comprising at least one digital signal processor for transforming the incoming sound signal into a transformed signal in conformity with the desired transformation function, and at least one receiver and a power supply, and having at least one sensing means for sensing the signal appearing in front of the eardrum, and at least one comparison means.

Measurements and corrections for linear or nonlinear distortions in hearing aids are known from the prior art, particularly from German Publication DE 28 085 16, which discloses a hearing aid, which in addition to the receiver uses a measurement microphone or probe microphone, which could be separate from the receiver or incorporated or integrated into the receiver. This microphone picks up the sound environment in the ear canal in front of the eardrum and is used for the compensation of linear and/or nonlinear distortions of the signal.

The instantaneous analog values of the output signal of the probe microphone are applied at one input of a differential amplifier, the second input of which receives the undistorted output signal of a preamplifier of the hearing aid. The output signal of the differential amplifier is then applied as a correction voltage which is added to the input signal of the output amplifier, resulting in a corrected output signal from the receiver.

Thus, the probe microphone and the differential amplifier are part of a feedback loop for correcting distortions of the output signals of a hearing aid.

However, this known system can not adapt itself in real time to instantaneous variations of the entire electroacoustic system, comprising of the ear and the hearing aid, preferably a programmable or program controlled digital hearing aid system.

In U.S. Pat. No. 4,596,902, a hearing aid is disclosed having a feedback microphone located in the ear canal when the hearing aid is in use. The feedback microphone monitors actual sound pressure levels in the ear canal, and the hearing aid adjusts individual gains in a plurality of frequency bands in response to a comparison of the monitored sound pressure in the ear canal and in the frequency band in question with a respective predetermined value so that the sound pressure level is kept below a loudness discomfort level in each frequency band.

In Widin G. P.: "The meaning of digital technology", Hearing Instruments, vol. 38, No. 11,1 November 1987, various types of use of digital signal processing in hearing aids are discussed in general. The discussion is divided into discussions of use of computers in hearing instrument fitting, use of digital circuitry to control analogue electronics, use of digital signal processing to replace analogue circuits to accomplish standard hearing instrument functions, and use of digital techniques to produce new kinds of signal processing, such as noise suppression.

CH 624 524 A discloses a hearing aid with a microphone, an amplifier and a loudspeaker. The hearing aid further comprises a feedback microphone for monitoring sound emitted by the loudspeaker and generating an output signal that is fed back into the amplifier for correction of the output generated by the hearing aid.

It is an object of the present invention to create and develop a novel method for an instantaneous measurement and correction or adaption of the sound environment in front of the eardrum, even including occlusion effects and other foreign signals or sounds influencing the sound field in front of the eardrum, to a desired sound signal.

A model function of this type may be developed and one may even be able to predict or anticipate changes in the sound environment in front of the eardrum by such a method.

SUMMARY OF THE INVENTION

These objects are achieved by means of a method of the kind referred to above which in accordance with the invention is characterized by establishing a model of the electroacoustic system of comprising the ear and the hearing aid, said model simulating the actual sound signal in the ear in front of the eardrum, and storing said model in the hearing aid, sensing the actual signal appearing in front of the eardrum, converting said sound signal into a digital representation and feeding it back to an input of the digital signal processing system, comparing said digital representation of said sensed signal with said model in said comparison means and, in case there is a material difference between the sensed signal and the model, to generate an error signal for adjusting said model to the actual sound environment in front of the eardrum, and by further using said error signal to adaptively modify the process in said digital signal processor by minimizing said error signal.

It is particularly advantageous, if the entire operation is performed digitally, which would lead to large scale integration of most or almost all components of the system.

Further advantages of the invention will become apparent from the remaining claims and the description.

BRIEF DESCRIPTION OF THE DRAWINGS

The invention will now be described in detail with respect to several embodiments shown in the attached drawings.

In the drawings

DETAILED DESCRIPTION OF THE INVENTION

Figure 1:
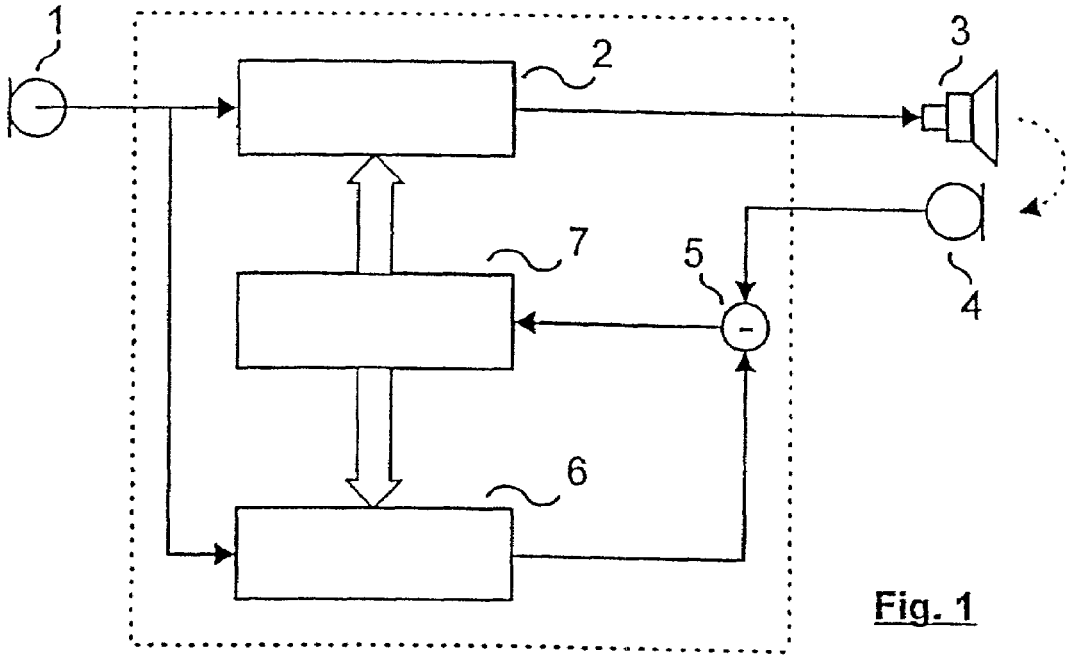
FIG. 1 shows schematically a first embodiment of a hearing aid to be used for practising the inventive method.

In the hearing aid as shown schematically in FIG. 1, the acoustical sound pressure prevailing in the environment surrounding the user is picked up by an input transducer of the hearing aid, in this case a microphone 1. The output signal of microphone 1 is applied to a processing system, preferably a digital signal processing system operating in accordance with the present invention and containing at least one digital signal processor 2, which processes the incoming signal in accordance with the hearing deficiency of the user and to the prevailing acoustical environmental situation. The output of the digital processor 2 is passed on to an output transducer, in this case a receiver 3.

The sound pressure levels in the earcanal are sensed by at least one sensing means, in this case by a probe microphone 4 that can be separate from the receiver, or incorporated into the receiver.

Equally, the receiver could be used also as a probe transducer or as such in combination with a probe microphone.

Principally, while the drawings show a hearing aid for performing the inventive method as a single channel hearing aid, it is to be understood that, obviously, the invention is by no means limited to single channel hearing aids but is, preferably so, also applicable to multi-channel hearing aids.

Also it is to be understood that in place of one input transducer or microphone several microphones could be provided as well as any other conceivable type of input transducer producing an input signal.

The output transducer could as well be any type of output transducer that produces an output signal, f.i. a sound signal in front of the eardrum.

Furthermore, analog to digital and digital to analog converters would have to be employed, where required, preferably in the form of sigma-delta-converters.

The sensing means, i.e. the probe microphone 4 is directly or indirectly connected to a comparison means 5. Furthermore there is shown a model processor 6 which receives one input signal from the input side of the digital signal processor 2 or from the output of the microphone 1. The model processor 6 is also connected to the comparison means. When, initially, establishing the model function, the entire system has to be taken into account, i.e. the complete ear including the outer ear with the earlobe as well as the eardrum and the inner ear and also the hearing aid. This means that, when establishing the model in the customary way all facets of the ear and the hearing aid have to be taken into consideration. This model then may perform a representative simulation of the actual sound signal in front of the eardrum.

The establishment of such a model is a well known scientific research tool.

However, in the present case, this model, once it is established, as a model function, it is to be stored in the hearing aid, preferably in the model processor 6.

It has to be understood that this model processor 6, at least basically or in parts may operate in a manner similar to the operation of the digital signal processor 2 in conjunction with the output transducer of receiver and the sensing means.

This process, of course, is adjustable by the operation of the entire circuitry.

Finally, preferably in combination with the model processor 6 a parameter adjustment processor 7 is provided and is also connected to the comparison means.

Of course, in a preferred embodiment of such a hearing aid to be used for practising the inventive method, all operations in the various circuits are performed digitally. This means that between the microphone 1 and the digital signal processor 2 an analog to digital converter has to be provided. The same applies to the connection between the sensing means 4, i.e. the probe microphone and the comparison means 5. Since the model processor 6 is also operating digitally, the signals applied to the model processor 6 have to be in digital form or must be converted into digital form in the model processor 6. The parameter adjustment processor 7 will also be operated digitally with the same requirements.

In operation, after establishing the model function in the model processor 6, the ambient sound spectrum prevailing is picked up by the microphone 1 and operated on in the digital signal processor 2 in accordance with the parameters set into the hearing aid, transforming the incoming sound signal into a desired sound signal in front of the eardrum by means of an output transducer, i.e. the receiver 3.

The sensing means 4, i.e. the probe microphone senses the signal or the sound pressure level in front of the eardrum. The output signal of the probe microphone is then, either directly or indirectly applied to the comparison means 5 which also receives the signal from the model processor 6 as a second input signal. If, at the comparison means 5, a material difference is detected between the two signals, an error signal is developed. This error signal is applied to the parameter adjustment processor 7 where it is analized. In accordance with this analysis of the error signal, the parameter adjustment processor 7 may then change the parameter set controlling the transfer characteristic of the digital signal processor 2 and/or the model processor 6 to adapt or change the model as well. For this purpose the parameter adjustment processor 7 is also connected to the digital signal processor 2 and to the model processor 6.

In this analysis the parameter adjustment processor 7 determines whether the error signal is inside an acceptable range of values or not. If the error signal is outside an acceptable range of values, the parameter adjustment processor operates on the digital signal processor 2 to change its set of parameters and, eventually, sets up a new acceptable range for the error signal and/or adapts or corrects the process in the model processor 6 to change or adapt the model.

This means that the process in the parameter adjustment processor 7 is changed to an improved process and thus also to an improved model in the model processor 6. This new model function now controls the digital signal processor 2 to adapt the output of the receiver 3 in such a way as to approach the signal in front of the eardrum as closely as possible and, of course, preferably in real time, to the desired sound signal in front of the eardrum.

It goes without saying that the operation between the units 5, 6 and 7 can be analog or digital, with the corresponding analog to digital and digital to analog converters in the corresponding locations This is state of the art.

After this detailed description of the circuitry and operation of FIG. 1 the following figures and their operation can be described in less detail, the more so as several processors are substantially the same and are designated with the same reference numerals.

Figure 2:
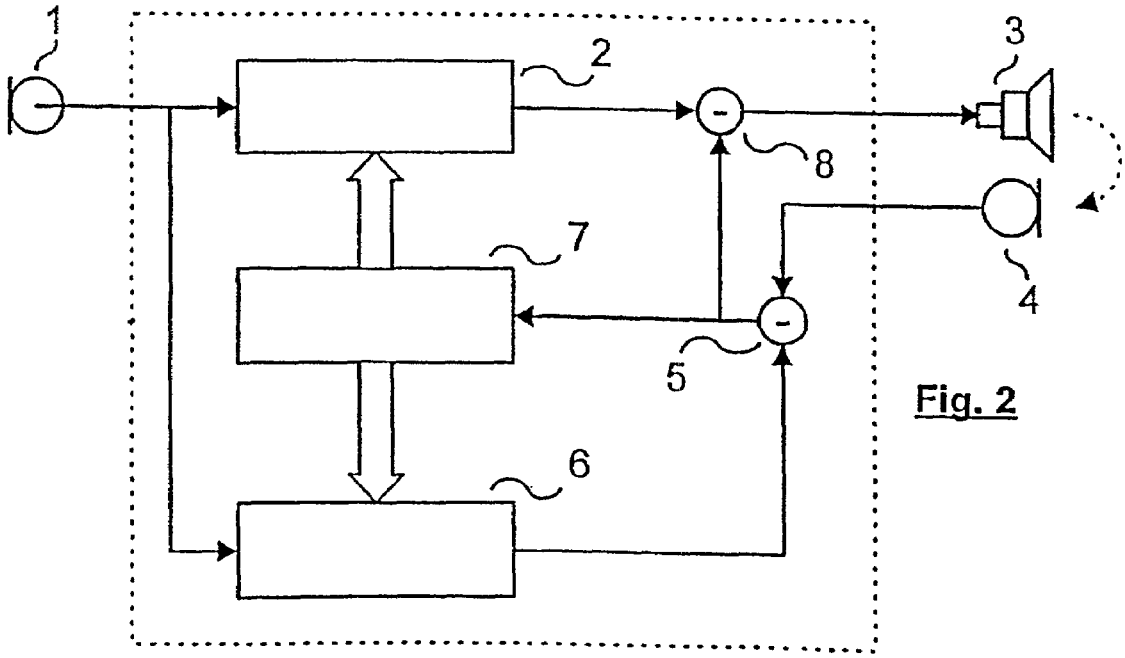
FIG. 2 shows schematically a second embodiment of such a hearing aid.
Figure 3:
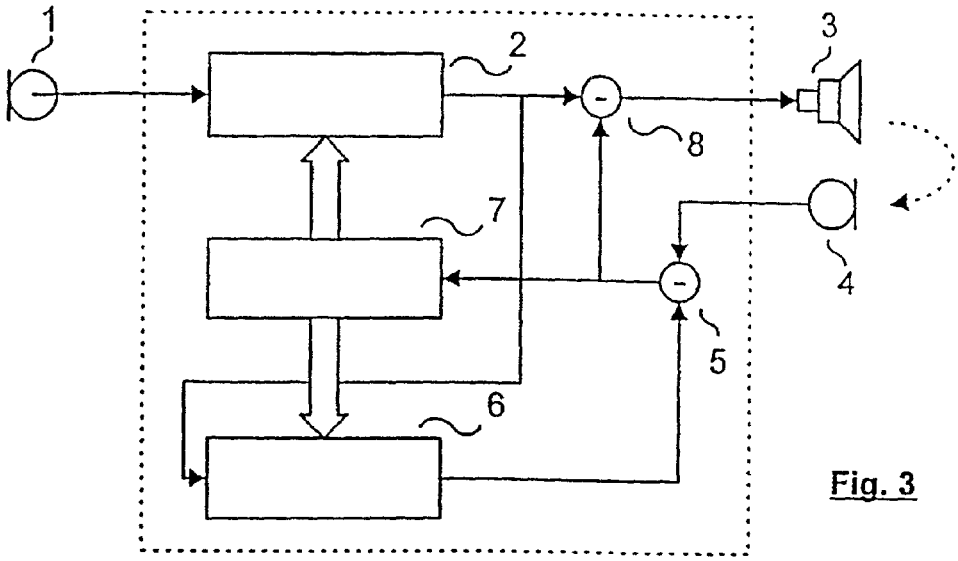
FIG. 3 shows a third embodiment of said hearing aid.
Figure 4:
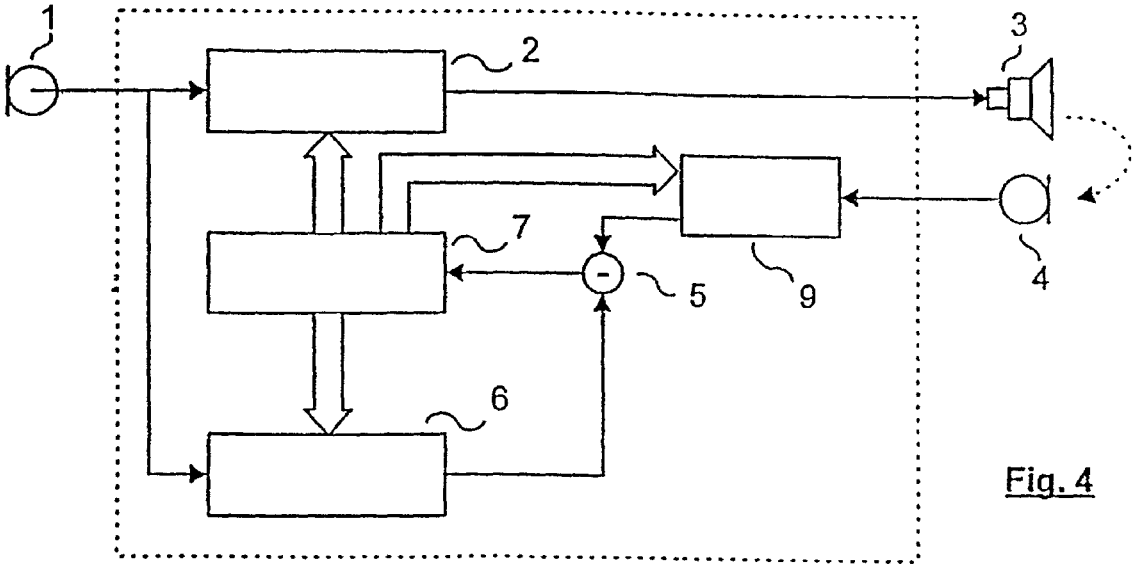
FIG. 4 shows another embodiment of said hearing aid.

All systems variations, i.e. single channel or multiple channel hearing aids which were already described with respect to FIG. 1 apply, mutatis mutandis, to FIGS. 2, 3 and 4 as well and need not to be repeated.

FIG. 2 shows a similar hearing aid for performing the inventive method, comprising an input transducer, a microphone 1, a digital processing system including f.i. at least one digital signal processor 2, an output transducer 3, a sensing means 4, a comparison means 5, a model processor 6 and a parameter adjustment processor means 7, which prefereably is incorporated into the model processor 6.

Additionally, a further modification means or correction means 8 between the output of the digital signal processor 2 and the output transducer 3 for further influencing the output signal of the output transducer 3 in real time, is also connected to the comparison means 5 to control the input signal for the output transducer 3.

The possible material difference between the output signal of the sensing means 4 and the output signal of the model processor 6 and the processor 7 in comparison means 5 results again in an error signal which will also directly influence the output signal of the digital signal processor 2 via the modification means 8 and consequently the input signal to the output transducer 3. This will diminish or reduce the error signal almost immediately.

This may be of particular interest in case the error signal is the result of an erroneous transmission of an audio signal through the hearing aid into the sensing means, i.e. the probe microphone 4.

This error signal may also have been caused by other sources which may introduce a sound signal into the earcanal or the ear, f.i. occlusion effects, which could be overcome immediately.

The hearing aid shown in FIG. 3 is in many respects quite similar to the hearing aids shown in FIGS. 1 and 2 so that all generic remarks made in connection with those figs. apply also in FIG. 3.

However, the hearing aid shown in FIG. 3 differs in a material way from the previous figures.

One input signal for the model processor 6 is now derived at the output of the digital signal processor 2 and not from its input side. Thus, the model processor 6 does not have to emulate similar processing capabilities as provided in the digital signal processor and therefore can be less complex.

However, both systems have their advantages. The system in FIGS. 1 and 2 gives more time to process the signal in the model processor 6, for generating the model, whereas deriving the input signal for the model processor 6 from the output of the digital signal processor 2 reduces the processing time in the model processor 6, and reduces the complexity of the model processor 6, that would have been required.

Finally, FIG. 4 shows another embodiment of a hearing aid for performing the inventive process.

FIG. 4 shows an arrangement similar to the one shown in FIGS. 1 and 2, where the model processor 6 is connected to the input side of the digital signal processor 2 or even to the output side of the microphone 1.

However, the sensing means, i.e. the probe microphone is now connected to a probe signal correction processor 9 which could include an analog to digital conversion means and even means for frequency characteristic correction and frequency band splitting, if so required. Such preprocessing for frequency characteristic correction can be of real advantage because it may then not be necessary to correct the individual probe microphone characteristics in the model processor 6.

As can be seen from FIG. 4 the probe signal processor 9 may be controlled and adjusted from parameter adjustment processor 7. The proprocessed probe microphone signal and the output from the model processor 6 are both applied to comparison means 5. In case there is a material difference between the two signals applied to comparison means 5, an error signal is developed to influence the parameter adjustment processor 7 in the way as described in connection with FIGS. 1 and 2.

At the same time, the error signal developed at comparison means 5 influences the process in the parameter adjustment processor 7 which results in an adjustment of the model in the model processor 6 and determines the transmission characteristic of the digital signal processor 2 and finally, of course, the input signal to the output transducer, i.e. the receiver 3 and thus the sound signal in the earcanal in front of the eardrum as closely as possible to the desired sound or sound pressure levels.

Generally, it may be said that in FIG. 1 there is shown only one input to a model processor 6, one comparison means 5 and, of course, one error signal developed from a comparison of the output signal of the sensing means and the model from the model processor 6 and in conjunction with the function in parameter adjustment processor 7. There are, of course, possibilities to use multiple processors to create multiple error signals as well.

With this new method a more sophisticated adjustment or correction of the sound signal appearing in front of the eardrum, almost in real time, will be possible.

What is claimed is:

1. A method to measure and correct or adjust a sound signal presented to an eardrum by means of a hearing aid in its operational position, said hearing aid including at least one microphone, at least one digital signal processing system comprising at least one digital signal processor for transforming an incoming sound into a transformed signal in conformity with a desired transformation function, said hearing aid having at least one receiver, at least one sensing means for sensing the signal appearing in front of the eardrum, and at least one comparison means (5), said method comprising the steps of:

A. establishing a model of an electroacounstic system comprising the ear and the hearing aid, said model simulating the actual sound signal in the ear canal in front of the eardrum, and storing said model in the hearing aid, B. sensing the actual sound signal appearing in front of the eardrum, converting said sound signal into a digital representation and feeding it back to an input of the digital signal processing system, C. comparing said digital representation of said sensed signal with said model in said comparison means and, in case there is a material difference between the sensed signal and the model, generating an error signal for adjusting said model to the actual sound environment in front of the ear-drum, and by further using said error signal to adaptively modify the process in said digital signal processor by minimizing said error signal.

2. A method according to claim 1, further comprising the step of storing said model in a model processor and using said material difference from said comparison as an error signal to adaptively modify said model in said model processor, updating said model to the actual sound environment in front of the eardrum.

3. A method according to claim 1, wherein said step of using said error signal to modify the process in said digital signal processor comprises using said material difference of the comparison as an error signal for a parameter adjustment processor in said digital signal processing system for adjusting the process in said digital signal processor.

4. A method according to claim 3, further comprising the step of using said material difference from said comparison as an error signal for said parameter adjustment processor to modify the model in said model processor.

5. A method according to claim 3, further comprising the step of using said material difference of said comparison as an error signal for said parameter adjustment processor to adjust transformation parameters of said digital signal processor and said model function in said model processor.

6. A method according to claim 1, further comprising the step of using said material difference from said comparison as an error signal for a process in a microphone signal correction processor connected between said sensing means and said comparison means.

7. A method according to claim 1, further comprising the step of using said material difference from said comparison as an error signal to modify the transformed signal from said digital signal processor in a modification means.

8. A method according to claim 6, further comprising the step of using said at least one comparison means, said model processor and said parameter correction processor and said microphone signal correction processor (9) as at least parts of the electroacoustic model.

9. A method according to claim 1, wherein said sensing means comprises a probe microphone.

10. A method according to claim 1, wherein said receiver is used as said at least one sensing means (4).

11. A hearing aid including means to measure and correct or adjust the sound signal presented to the eardrum in the operational position of said hearing aid, said hearing aid including at least one microphone, at least one digital signal processing system comprising at least one digital signal processor for transforming an incoming sound into a transformed signal in conformity with a desired transformation function, said hearing aid further having at least one receiver, at least one sensing means for sensing the sound signal appearing in front of the eardrum, and at least one comparison means, wherein said signal processing system includes processing and storing means adapted to hold a model function of an electroacoustic system comprising the ear and the hearing aid, thus simulating the actual sound signal in front of the eardrum, the said comparison means comparing the signal sensed in front of the ear drum with the said model function to generate at least one error signal for adjusting said model to the actual sound environment in front of the eardrum, and wherein the digital signal processing system also contains modification means for effecting, in response to said at least one error signal, a modification of the output signal of the digital signal processor into a corrected transformed signal, when there is a material difference between said sensed signal and said simulated model.

12. A hearing aid in accordance with claim 11, wherein said modification means in said signal processing system is arranged to receive said at least one error signal from said comparison means to modify said transformed signal.

13. A hearing aid according to claim 11, wherein the modification means in said signal processing system contains a parameter adjustment processor that is arranged to receive said at least one error signal from said comparison means to adaptively modify the process in said digital signal processor.

14. A hearing aid according to claim 11, wherein the modification means in said signal processing system contains a parameter adjustment processor (7) that is arranged to receive at least one error signal from said comparison means (5) to adaptively modify the process in said model processor.

15. A hearing aid in accordance with claim 11, wherein the modification means in the signal processing system contains a parameter adjustment processor arranged to receive said at least one error signal from said comparison means to adaptively modify the process in said digital signal processor and in said model processor.

16. A hearing aid in accordance to claim 11, wherein a microphone signal correction processor is provided between said sensing means and the comparison means, said processor being arranged to receive said at least one error signal from said comparison means to adaptively modify the process in said microphone signal correction processor.

17. A hearing aid according to claim 11, wherein at least one comparison means, said model processor containing a parameter correction processor and said microphone signal correcting processor are at least parts of said electroacoustic model.

* * * * *